United States Patent [19]

Argyle et al.

[11] 4,234,040

[45] Nov. 18, 1980

[54] TWO FLUID HEAT EXCHANGER

[75] Inventors: Charles S. Argyle, Willowdale; Robert G. Bamsey, Kitchener; Gregory S. T. Millard, Brampton, all of Canada

[73] Assignee: Borg-Warner Corporation, Chicago, Ill.

[21] Appl. No.: 918,198

[22] Filed: Jun. 22, 1978

Related U.S. Application Data

[62] Division of Ser. No. 716,628, Aug. 23, 1976, abandoned.

[51] Int. Cl.[3] ..... F28F 3/12

[52] U.S. Cl. ..... 165/164; 123/570; 165/51

[58] Field of Search ..... 165/164, 166, 167; 123/119 A

[56] References Cited

U.S. PATENT DOCUMENTS

| | | | |
|---|---|---|---|
| 2,343,315 | 3/1944 | Morrison | 165/164 X |
| 2,977,940 | 4/1961 | Theriault | 123/119 R |
| 3,399,720 | 9/1968 | Doelz et al. | 165/166 X |

*Primary Examiner*—Albert W. Davis
*Attorney, Agent, or Firm*—James A. Geppert

[57] ABSTRACT

A two fluid heat exchanger adapted for utilization in an exhaust gas recirculation system of an automotive internal combustion engine to reduce the temperature level of the exhaust gas from the combustion cycle that is metered from the exhaust manifold and recycled through the combustion cycle. The heat exchanger has a generally flat configuration with a first pair of flanged dished plates forming an inner chamber and a second pair of flanged dished plates encompassing the first pair of plates to form a fluid envelope around the inner chamber. The flanges of the pairs of plates are joined together with a spacing between the walls of the pairs of plates at the opposite ends with the inner flanges having openings therethrough to communicate between the upper and lower portions of the envelope. The upper plate of the second pair has an inlet opening and an outlet opening for one fluid and a central indentation between the openings to provide a flow pattern around the inner chamber, and a second fluid inlet and outlet communicate with the inner chamber.

10 Claims, 9 Drawing Figures

5
C
D
31
47
60
51
59
56
50
53
48
3
52
54
50
51
3
51a
B
49
49a
42
41
51a
2
A

TWO FLUID HEAT EXCHANGER

This is a division of application Ser. No. 716,628 filed Aug. 23, 1976 now abandoned.

BACKGROUND OF THE INVENTION

The present invention relates to exhaust gas recirculation in the automotive internal combustion engine and more particularly to a means for cooling the exhaust gas that is returned to the combustion cycle. Since approximately 1971, automotive vehicle manufacturers have been required to add an ever-increasing number of components or systems to the vehicle or the internal combustion engine therein to increase the safety of the vehicle or decrease the emissions inherent in the exhaust gases from the internal combustion engine. Such components include positive crankcase ventilation, exhaust gas recirculation, an evaporation control system and a catalytic converter in the exhaust line.

Of major concern are the emissions from the exhaust gas of an internal combustion cycle which have been blamed for conditions such as smog occurring in large cities where a large number of automobiles are present each day. The oxides of nitrogen are one such emission, and an exhaust gas recirculation cycle is used to reduce these oxides present in the engine exhaust. Formation of nitrogen oxides takes place at very high temperatures and consequently occurs during the peak temperature period of the combustion process. To reduce and control nitrogen oxides formation, only a slight reduction in peak temperature is required.

This temperature reduction can be accomplished by introducing small amounts of an inert gas into the combustion process and, as the end products of combustion provide a continuous supply of relatively inert gases, it becomes a matter of utilizing those gases in the correct proportion. Thus, a recirculation passage is connected to the exhaust manifold and to a vacuum modulated shut-off and metering valve installed on the inlet manifold to control the flow of exhaust gases. The recirculation or additional exhaust gas passages are closely positioned to the engine or may be cast into the complex runner system of the inlet manifold.

However, the exhaust gases from the internal combustion engine cycle are still at a very high temperature level and it is desirable to substantially reduce that temperature level before the gases are reintroduced into the combustion cycle. The present invention accomplishes this desired temperature reduction.

SUMMARY OF THE INVENTION

The present invention comprehends the provision of a two fluid heat exchanger and more particularly to a heat exchanger adapted to be inserted in the exhaust gas recirculation system of an automotive internal combustion engine to cool the recirculating exhaust gases before reintroduction into the inlet manifold. The heat exchanger is of a compact design to fit within the relatively crowded space in the engine compartment of the vehicle and to be easily mounted on the engine without substantially increasing the flow path of the recirculating gases.

The present invention also comprehends the provision of an two fluid heat exchanger having an outer envelope of a second fluid around a generally central first fluid flow passage to reduce as far as possible the escape of heat to adjacent areas around the heat exchanger.

The present invention further comprehends the provision of an two fluid heat exchanger which provides for adequate fluid flow therethrough with low resistance or pressure drop. Although primarily utilized for exhaust gas recirculation systems, the same heat exchanger could be used to extract heat from the other exhaust gas flow and for other purposes, such as a fast passenger compartment heat-up system or for a gas turbine heat exchange system, or other heat exchange situations involving two fluids. The heat exchanger is formed of suitable materials to resist corrosion and decay in the highly corrosive exhaust gas environment.

Further objects are to provide a construction of maximum simplicity, efficiency, economy and ease of assembly and operation, and such further objects, advantages and capabilities as will later more fully appear and are inherently possessed thereby.

DESCRIPTION OF THE PREFERRED EMBODIMENTS

Figure 1:
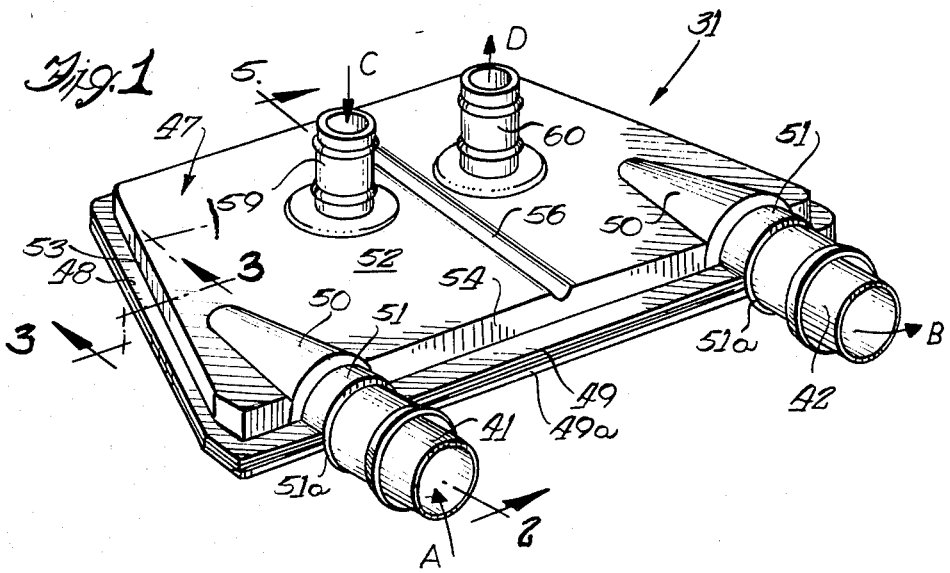
FIG. 1 is a perspective view of the two fluid heat exchanger.
Figures 2, 3, 4, 5, 6, 7:
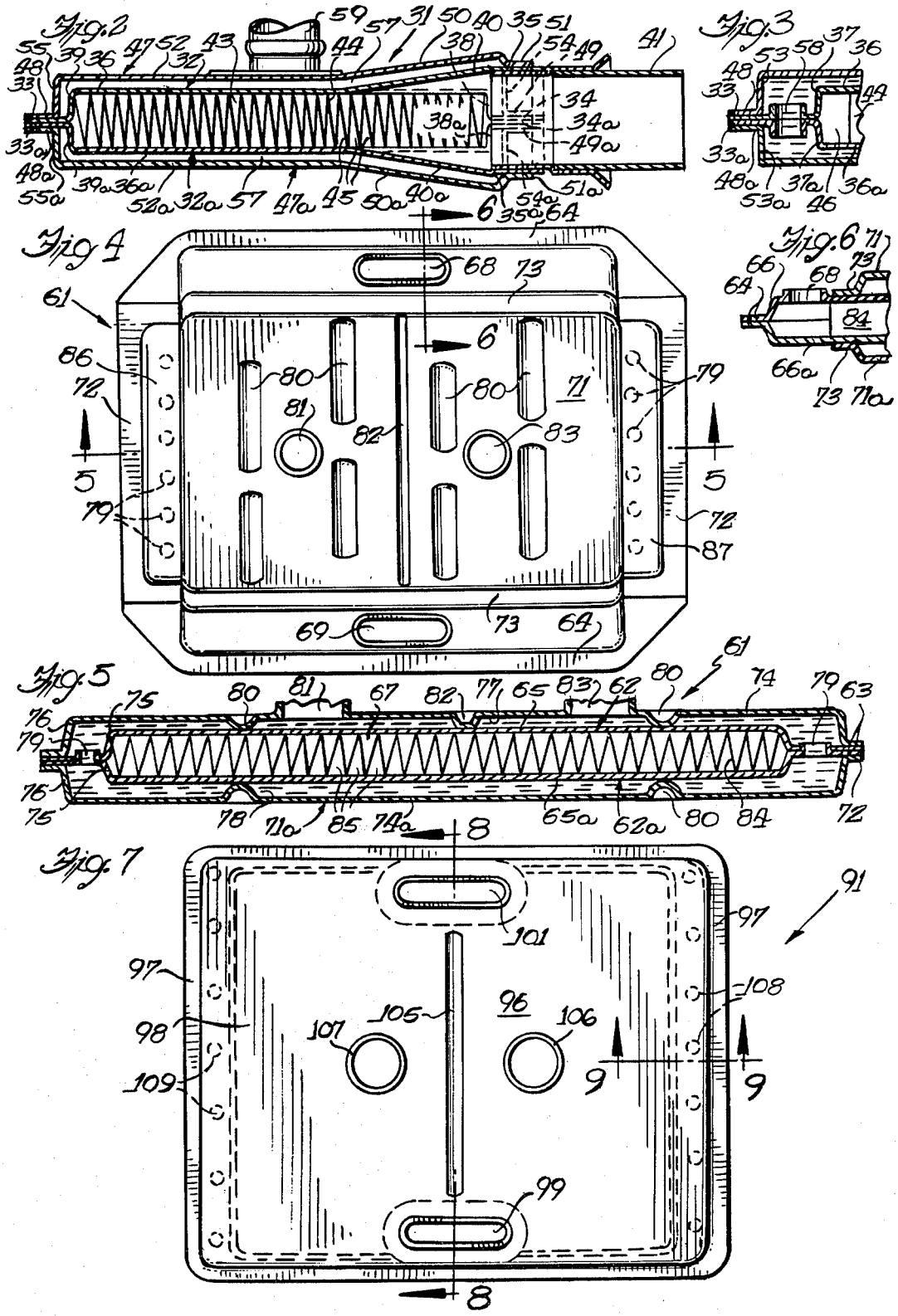
FIG. 2 is a vertical cross sectional view taken on the line 2—2 of FIG. 1.
FIG. 3 is a partial vertical cross sectional view taken on the irregular line 3—3 of FIG. 1.
FIG. 4 is a top plan view of an alternate embodiment of heat exchanger.
FIG. 5 is a vertical cross sectional view taken on the line 5—5 of FIG. 4.
FIG. 6 is a partial vertical cross sectional view taken on the line 6—6 of FIG. 4.
FIG. 7 is a top plan view of a third embodiment of heat exchanger.

Referring more particularly to the disclosure in the drawings wherein are shown illustrative embodiments of the present invention, FIGS. 1 through 3 disclose a two fluid heat exchanger 31 having a generally flat configuration which will easily and compactly fit alongside the vehicle engine in the limited space of the engine compartment. This heat exchanger is formed from four stamped pieces of sheet metal comprising a pair of symmetrical inner sheets **32,32*a* and a pair of generally identical outer pieces 47,47*a*; the inner pieces having flat flanges 33,33*a* around three sides of the unit and generally flat flanges 34,34*a* on the fourth side provided with two pairs of oppositely disposed embossments 35,35*a*; the embossments 35 extending above the plane of the flanges 34,34*a* and the other embossment 35*a*** extending below the flange plane.

The pieces **32,32*a* have oppositely dished central portions 36,36*a* with generally vertical side walls 37,37*a* merging into the flanges 33 and converging away from the walls 38,38*a* merging into the flanges 34. The walls 37,37*a* converge toward walls 39,39*a* parallel to and opposite the wall 38. Generally conical embossments 40,40*a* are formed in the central portions 36,36*a* and merge into the embossments 35,35*a* to define openings for an inlet conduit 41 and an outlet conduit 42. The conical embossments 40,40*a*** also merge into the sheets 32,32*a* as seen in FIG. 5. Within a central chamber 43 formed by the dished portions 36,36*a*, is positioned a partially folded turbulizer 44 extending longitudinally in the chamber to divide the chamber into a plurality of parallel flow passages 45; the turbulizer terminating short of the ends of the chamber to form an entrance tank 46 and an exit tank (not shown) for the first fluid or exhaust gas.

The outer pieces 47,47*a* also have flat flanges 48,48*a* sandwiching the flanges 33,33*a* around three sides of the heat exchanger and generally flat flanges 49,49*a* sandwiching the flanges 34,34*a* on the fourth side. Conical embossments 50,50*a* are formed in central dished portions 52,52*a* defined by the flanges 48,48*a*, 49,49*a* with outer edges 51,51*a* engaging and secured to the embossments 35,35*a*. The dished portions 52,52*a* have side walls 53,53*a* converging from a rear wall 54,54*a* having the embossments therein and toward forward walls 55,55*a* parallel to the walls 54,54*a*; the walls being spaced outwardly of the walls of the inner dished portions 36,36*a*. A central indentation 56 in the dished portion 52 engages its respective inner dished portion 36 to divide the upper portion of the fluid envelope 57 formed between the dished portions 36,36*a*, 52,52*a* to cause flow of the second or cooling fluid into the lower envelope portion.

The flanges 33 of the inner sheets 32,32*a*, as seen in FIGS. 5 and 6, act to divide the fluid envelope 57 into upper and lower portions; however, fluid ports or openings 58 are formed in the oppositely disposed flanges 33 at the opposite ends of the inner pieces to allow fluid communication and flow between the upper and lower portions of the envelope. A second or cooling fluid inlet conduit 59 and a fluid outlet conduit 60 are secured in the upper piece 52 adjacent the indentation 56; the conduits communicating with the upper portion of the fluid envelope 57. As shown by the arrows in FIG. 1, the first fluid or hot exhaust gas enters the conduit 41 (arrow A) into the entrance tank 46, passes through the parallel passages 44 to the exit tank, and the cooled fluid leaves through the conduit 42 (arrow B). The second fluid or cooling water enters conduit 59 (arrow C) into the communicating half of the upper portion of the envelope 57 passes down through the openings 58 to the lower envelope portion, flows across the lower portion and up through the opposite set of openings 58 to the other half of the upper envelope portion and exits through the conduit 60 (arrow D) to cool the first fluid.

FIGS. 4, 5 and 6 disclose a alternate embodiment of heat exchanger 61 having a generally rectangular symmetrical configuration. This device includes a pair of inner metal sheets 62,62*a* having parallel side flanges 63 and curved end flanges 64; the sheets having oppositely dished portions 65,65*a* with dished end extensions 66,66*a*. The dished portions 65,65*a* form a central chamber 67 for the first fluid, with the extensions 66,66*a* forming inlet and outlet chambers. An elongated opening 68 in the extension 66 forms an inlet port and an elongated opening 69 forms the outlet port in the opposite extension 66.

A pair of outer sheets 71,71*a* have flanges 72 engaging the flanges 63 (see FIG. 5) and flanges 73 engaging the dished extensions 66,66*a* (FIG. 6); the sheets having oppositely dished portions 74,74*a* cooperating with the dished portions 65,65*a* to provide a second fluid envelope around the chamber 67. As seen in FIG. 5, the walls 75 of dished portions 65,65*a* are spaced inwardly of the walls 76 of dished portions 74,74*a* with the side flanges 63 dividing the fluid envelope into upper and lower portions 77 and 78, respectively, and provided with openings 79 formed therein to provide communication between these two portions. Embossments 80 are preferably formed in the sheets 71,71*a* to extend into the second or cooling fluid envelope.

The sheet 71 has a fluid inlet conduit 81 formed in the dished portion 74 on one side of a central depression 82 and a fluid outlet conduit 83 adjacent the opposite side of the depression. The central transverse elongated depression 82 is formed across the dished portion 74 and extends inwardly to contact and be joined to the dished portion 65 of the upper sheet 62. This depression 82 effectively divides the upper envelope portion 77 in half to provide the desired flow pattern for the fluid.

In use, the first fluid or hot exhaust gas enters the inlet port 68 in the inlet chamber and passes into the central chamber where a partially folded metal sheet 84 forms a plurality of flow passages 85. The cooled first fluid flows into the outlet chamber and exits through the port 69. Also, the second or cooling fluid, such as water, enters the upper portion 77 of the envelope via the conduit 81, but is stopped from directly flowing to the outlet conduit 83 by the depression 82. Thus, fluid flows from the upper portion through the openings 79 at the end 86 to the lower envelope portion 78, across the portion 78 to the openings 79 at the end 87 and enters the upper envelope portion 77 again to exit through the outlet conduit 83. The ribs or embossments 80 formed in the dished portions 71,71*a* (see FIG. 5) act to interrupt straight flow of the fluid in the envelope and turbulize the fluid to enhance the heat transfer and reduce any channelling of the flow of the cooling fluid.

Figure 8:
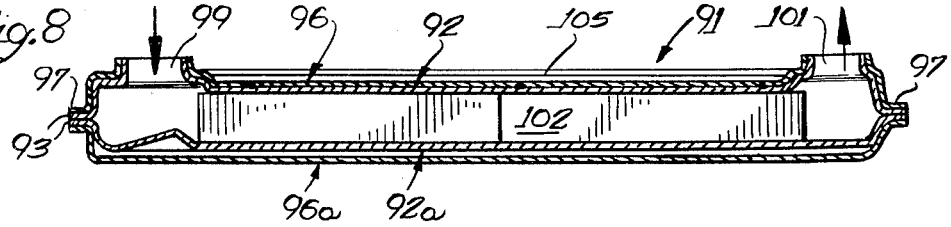
FIG. 8 is a vertical cross sectional view taken on the line 8—8 of FIG. 7.
Figure 9:
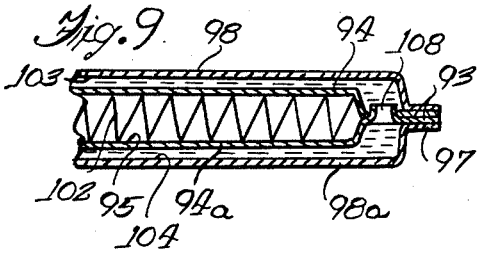
FIG. 9 is a partial vertical cross sectional view taken on the line 9—9 of FIG. 7.

FIGS. 7 through 9 disclose another heat exchanger 91 similar to that shown in FIGS. 4 through 6 except for the positioning of the first fluid or exhaust gas inlet and outlet. This heat exchanger 91 utilizes a pair of inner plates 92,92*a* having flanges 93 around the periphery and defining oppositely disposed dished portions 94,94*a* forming a central chamber 95. Outer metal sheets 96,96*a* have peripheral flanges 97 and oppositely dished portions 98,98*a*. As seen in FIG. 8, the first fluid or exhaust gas inlet 99 and the first fluid or exhaust gas outlet 101 are formed through both sheets 92,96, with the sheets being crimped together to form the conduits. A partially folded metal plate 102 is positioned in the chamber 95 to divide the flow of first fluid or hot gases and enhance heat transfer to the second or cooling fluid in the surrounding envelope.

The spacing between the dished portions forms a fluid envelope having an upper portion 103 and a lower portion 104. An elongated central depression or rib 105 is formed in the sheet 96 and engages the inner sheet 92 to divide the upper envelope portion 103 to two compartments; a fluid inlet conduit 106 in sheet 96 communicates with the compartment on one side of the rib 105 and the fluid outlet conduit 107 communicates with the opposite compartment. A plurality of openings 108 are formed in the flanges 93 between the spaced walls of the dished portions 92,92*a* and 98,98*a* adjacent the conduit 106 and a second set of openings 109 are formed in the flanges 93 adjacent the outlet conduit 107. The flow of first fluid or hot exhaust gas and second fluid or cooling water takes substantially the same paths as for the heat exchanger 61.

Obviously, in these embodiments, the water connections would be positioned in the outer envelope to provide the most effective distribution and circulation of the second fluid; and the folded metal sheet in the inner chamber acts to break up the first fluid flow into smaller streams to effectively maximize the heat transfer from the first fluid to the second fluid in the envelope. Also, the flow of the second fluid can be either concurrent or counter current to the gas flow, with the second fluid jacket shielding a very localized but high temperature zone. Although several embodiments and flow patterns have been shown and described by way of illustration, it is not our intent or desire to unnecessarily restrict the improvement by virtue of this limited showing.

We claim:

1. A two fluid heat exchanger comprising a generally flat heat exchanger formed of two pairs of metal plates, the inner pair of plates having oppositely disposed dished portions forming a chamber and joined by peripheral flanges, the chamber having an inlet and an outlet adapted to receive a first fluid, a heat transfer surface formed of at least one metal plate received in said chamber, and the outer pair of plates having oppositely disposed dished portions and peripheral flanges generally completely joined to the flanges of said inner plates, said outer dished portions cooperating with said inner dished portions to form a fluid envelope generally encompassing the chamber and having an inlet and an outlet to receive a second fluid therein, at least an oppositely disposed pair of side walls of said outer dished portions are spaced from side walls of said inner dished portions, said flanges of the inner plates extend between said inner and outer side walls to divide said envelope into upper and lower portions and have openings therein to provide communication between said upper and lower envelope portions, said second fluid inlet and outlet being located in one of the outer dished portions, and a central depression is formed in the same dished portion to extend across the dished portion and divide said upper envelope portion between the inlet and outlet into generally equal halves.

2. A two fluid heat exchanger as set forth in claim 1, in which the flow of the second fluid enters the inlet and corresponding upper envelope portion half, passes through the openings in the inner flanges adjacent the inlet, passes through the lower envelope portion to the openings in the inner flanges at the opposite side of the heat exchanger, enters the opposite upper envelope portion half and exits through the outlet.

3. A two fluid heat exchanger as set forth in claim 1, in which said first fluid inlet and outlet are positioned in one pair of aligned side walls of the inner and outer dished portions adjacent the opposite ends of the heat exchanger, said inner and outer flanges on the side of the heat exchanger receiving said first fluid inlet and outlet are embossed around the inlet and the outlet, and said chamber has an inlet portion and an outlet portion aligned with said first fluid inlet and outlet, and said partially folded metal sheet extends longitudinally between said inlet and outlet chamber portions.

4. A two fluid heat exchanger as set forth in claim 3, wherein said embossments in said inner and outer flanges merge into said inner and outer dished portions, respectively.

5. A two fluid heat exchanger as set forth in claim 1, wherein said inner dished portions are provided with oppositely disposed dished extensions projecting beyond the outer flanges, and said first fluid inlet and outlet are located in said extensions.

6. A two fluid heat exchanger as set forth in claim 5, wherein said inner dished extensions are located on two parallel sides, and the two outer dished portions extend beyond the inner dished portions on the opposite two parallel sides.

7. A two fluid heat exchanger as set forth in claim 6, in which said first fluid flow in said central chamber is generally transverse to the flow of said second fluid in said outer envelope.

8. A two fluid heat exchanger as set forth in claim 7, including a plurality of flow diverting ribs formed on said outer dished portions and extending into said fluid envelope portions.

9. A two fluid heat exchanger as set forth in claim 1, in which said fluid inlet and outlet are centrally located in one outer dished portion adjacent the central depression, and said first fluid inlet and outlet are centrally located in said same outer dished portion and extending through said inner dished portion at the opposite ends of the central depression, said first fluid inlet and outlet each being defined by flared portions of said adjacent inner and outer dished portions which are crimped together.

10. A two fluid heat exchanger as set forth in claim 1, in which said heat transfer surface comprises a partially folded metal sheet within said chamber and terminating short of one pair of opposed ends therein.

* * * * *

UNITED STATES PATENT OFFICE

CERTIFICATE OF CORRECTION

PATENT NO. : 4,234,040

DATED : November 18, 1980

INVENTOR(S) : Charles S. Argyle, Robert G. Bamsey and Gregory S. T. Millard

It is certified that error appears in the above-identified patent and that said Letters Patent are hereby corrected as shown below:

Column 6, line 35, insert -- second -- before "fluid inlet".

Signed and Sealed this

*Twenty-fourth* Day of *March 1981*

[SEAL]

*Attest:*

RENE D. TEGTMEYER

*Attesting Officer*

*Acting Commissioner of Patents and Trademarks*